United States Patent [19]

House et al.

[11] 4,447,004

[45] May 8, 1984

[54] CARTON HANDLE ARRANGEMENT

[75] Inventors: Richard F. House, St. Charles; Karl A. Kohler, Roselle, both of Ill.

[73] Assignee: Container Corporation of America, Chicago, Ill.

[21] Appl. No.: 464,708

[22] Filed: Feb. 7, 1983

[51] Int. Cl.[3] ..... B65D 5/46

[52] U.S. Cl. ..... 229/52 B; 229/44 R; 229/DIG. 6; 229/DIG. 9

[58] Field of Search ..... 229/52 B, 44 R, DIG. 6, 229/DIG. 9

[56] References Cited

U.S. PATENT DOCUMENTS

| | | | |
|---|---|---|---|
| 1,894,873 | 1/1933 | Johnson | 229/DIG. 9 |
| 2,702,663 | 2/1955 | Klein | 229/DIG. 9 |
| 2,718,301 | 9/1955 | Palmer | 229/52 B |
| 3,627,193 | 12/1971 | Helms | 229/DIG. 9 |
| 3,790,066 | 2/1974 | Malinowski | 229/52 B |
| 3,994,432 | 11/1976 | Kirby | 229/52 B |
| 4,109,849 | 8/1978 | Wood | 229/52 B |
| 4,121,757 | 10/1978 | Hamlin | 229/52 B |
| 4,331,289 | 5/1982 | Killy | 229/52 B |

*Primary Examiner*—William Price
*Assistant Examiner*—Gary E. Elkins
*Attorney, Agent, or Firm*—Richard W. Carpenter; Davis Chin

[57] ABSTRACT

A paperboard carton having a top wall structure with a reinforced handle arrangement for grasping and lifting the carton. The top wall structure and handle arrangement include a pair of overlapping inner and outer panels secured to each other and having thumb and finger receiving openings spaced from each other and separated by three plies of carton material to provide additional strength in the handle area of the carton top wall.

5 Claims, 4 Drawing Figures

CARTON HANDLE ARRANGEMENT

BACKGROUND OF THE INVENTION

1. Field of the Invention:

This invention relates generally to carrier cartons, and more particularly to a reinforced handle structure for a tubular carton having overlapped top wall panels secured to each other.

2. Description of the Prior Art:

A prior art search in the United States Patent and Trademark Office directed to the subject matter of this application disclosed the following U.S. Pat. Nos.: 1,009,804; 2,611,527; 2,684,759; 3,904,036; 3,974,911. French Pat. No. 2,274,509.

None of the prior art patents uncovered in the search disclosed a carrier carton structure like that of the present invention which includes a pair of overlapping top wall panels with cooperating finger and thumb receiving openings of different sizes to prevent the top wall of the carton from being twisted and weakened when is the carton is grasped and carried.

SUMMARY OF THE INVENTION

It is an object of this invention to provide a wrap-around style carrier carton formed from a unitary blank of foldable paperboard which has a reinforced handle structure in the top wall thereof.

A more specific object of the invention is the provision, in a carton of the type described, of a top wall structure including a pair of overlapping inner and outer panels secured to each other and having thumb and finger receiving openings spaced from each other and separated by three plies of carton material to provide additional strength in the handle area of the carton top wall.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 4:
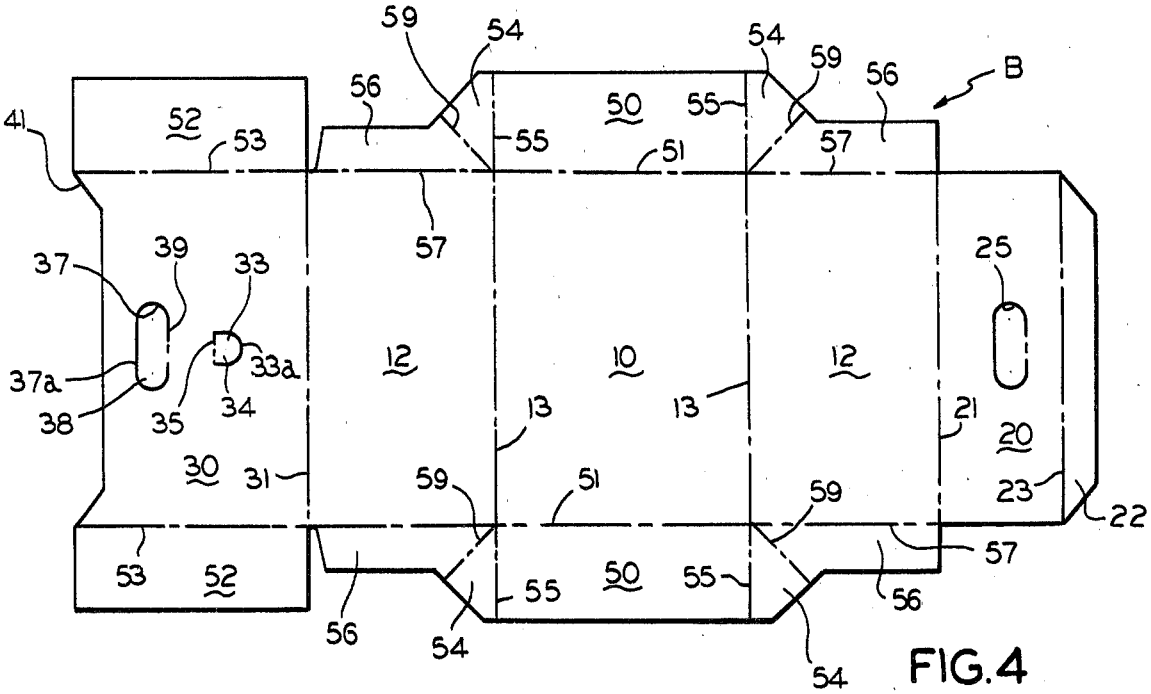
FIG. 4 is a plan view of a blank of foldable sheet material from which the carton illustrated in other views may be formed.
Figure 2:
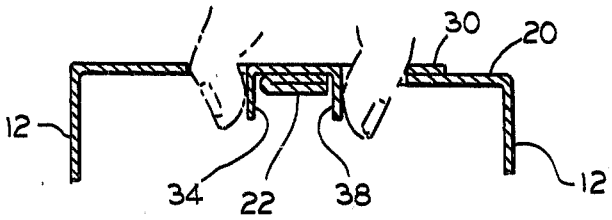
FIG. 2 is a fragmentary, transverse vertical, sectional view taken on line 2—2 of FIG. 1 and illustrating the manner in which the novel handle arrangement of the carton top wall permits the carton to be grasped and lifted.
Figure 1:
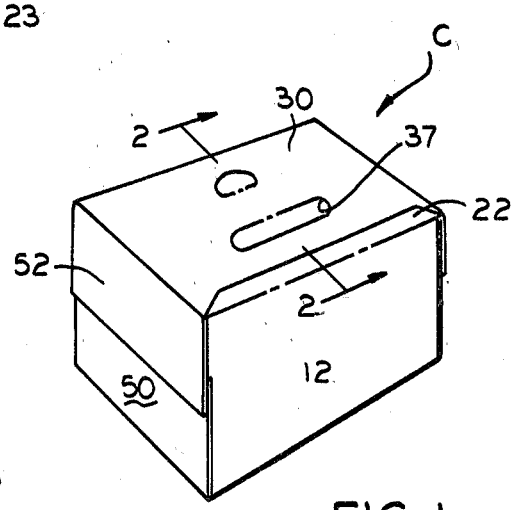
FIG. 1 is a perspective view of an erected carrier carton embodying features of the invention.

Referring now to the drawings for a better understanding of the invention, and particularly to FIGS. 1 and 2, it will be seen that a carrier carton, indicated generally at C includes an upper wall having a pair of openings which may be grasped by a thumb and fingers of a person to lift and carry the carton. The carton may be formed from a unitary blank B of foldably sheet material, such as paperboard, illustrated in FIG. 4 of the drawings.

Figure 3:
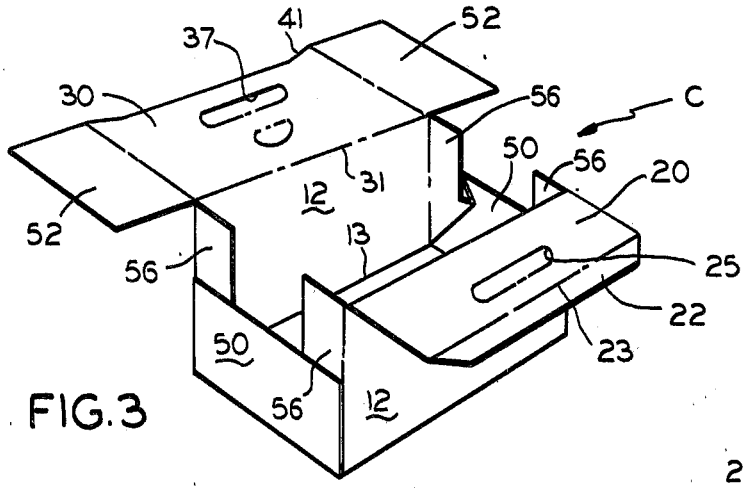
FIG. 3 is a perspective view similar to FIG. 1, but illustrating the carton at one stage of the assembly.

Referring now to FIGS. 1 and 3 of the drawings, it will be seen that the novel carton includes a preferably rectangular bottom wall panel 10 having a pair of side wall panels 12 foldably joined on line 13 to an adjacent side edge of panel 10.

A top wall 18 of the carton includes a pair of inner and outer panels 20 and 30 each are foldably joined to the upper edges of side wall panels 12 along fold lines 21 and 31, respectively.

As best seen in FIGS. 2 and 3, top wall inner panel 20 includes an elongated multi-finger receiving opening 25 which is spaced inwardly a slight distance from the outboard edge of panel 20. Panel 20 also has an elongated reinforcing flap 22 foldably joined to its outboard edge on fold line 23. It will be noted that the width of reinforcing flap 22 is substantially equal to the distance between the outboard edge of opening 25 and the outboard edge of panel 20, so that, as best seen in FIG. 2, when the reinforcing flap is folded 180° and secured in face-to-face relation with the underside of panel 20 it will fit in the space between the opening and edge of the panel.

Top wall outer panel 30 is also provided with a multi-finger receiving opening 37 which is spaced inboardly from the free edge of the panel and which has substantially the same contour and size as opening 25 in panel 20. Finger receiving opening 37 is defined in part by a cut line 37*a* which forms a tab 38 which, in turn, is foldably joined on fold line 39 to the inboard edge of opening 37.

Spaced inwardly from opening 39 is another opening 33, which is preferably round and only large enough to accommodate an average thumb. This opening 33, defined by a cut line 33*a* which also forms tab 34 foldably joined to outer panel 30 at the edge of opening 33 along a fold line 35. Openings 33 and 37 are spaced from each other a distance which is substantially equal to the width of the inner panel reinforcing flap 22, so that when the outer and inner panels are secured to each other in overlapped relationship, multi-finger receiving opening 25 is aligned with multi-finger receiving opening 37, and there are provided three plies of material between these two openings and thumb opening 33.

It will be noted that top wall outer panel 30 is provided with a recess 41 at the outboard side thereof which recess conforms in configuration to the contour of inner panel reinforcing flap 22. The purpose of this is to permit a nesting arrangement between similar blanks, but without sacrificing any strength in the top wall of the carton.

The ends of the carton may be closed by pairs of lower and upper end wall flaps 50 and 52 which are foldably joined to opposite end edges of bottom wall panel 10 and top wall outer panel 30 along fold lines 51 and 53, respectively.

It will be noted that the top wall end panels 52 have upper portions which extend the entire width of the top wall panel 30 at the end thereof.

The bottom wall end flaps 50 may be joined to the side wall lower sections 12 by means of a pair of generally triangular gusset panels 54 and 56 which are foldably joined on fold lines 55 and 57 to the related bottom wall end flaps and side walls respectively, and which are foldably joined to each other along a diagonal fold line 59.

In order to close the ends of the carton, gusset panels 54 and 56 are folded inward 90° and are tucked inside end wall flaps 50 and 52. Adjacent overlapping portions of the end wall flaps are then secured to each other in overlapping relation.

It should be appreciated that, because of the novel structure of the carton which provides the additional material outboardly of the multi-finger receiving opening in the top wall outer flap and also three plies of material between the multi-finger receiving openings and the thumb openings, there is provided a strong reinforced top wall panel. The purpose of providing the thumb opening, as distinguished from providing a pair of multifinger receiving openings, is to accommodate a bowling ball type grip for the top wall of the carton, so that twisting of the carton in the area between the top wall openings is minimized. Such twisting tends to weakened the carton and cause strain on the material of the top wall.

Thus, it will be appreciated that there is provided a carton of relatively simple design and construction which may be formed from a relatively thin, economically shaped blank of foldable sheet material and which provides a reinforced top wall panel permitting the lifting and carrying of relatively heavy articles.

What is claimed is:

1. A carrier carton for holding at least one article, said carton being formed from a unitary blank of foldable sheet material such as paperboard and comprising:

(a) a bottom wall panel;

(b) a pair of opposed side wall panels foldably joined to side edges of said bottom wall panel and upstanding therefrom;

(c) a top wall including integral handle means for lifting and carrying said carton, said top wall including a pair of inner and outer panels foldably joined to upper edges of respective side wall panels and secured to each other in lapped relation to form a tubular structure;

(d) said top wall inner panel including:

(i) a multi-finger receiving opening spaced inboardly from a side edge thereof;

(ii) an elongated reinforcing flap foldably joined to said side edge and adapted to be folded 180° and secured in face-to-face relation with the underside of said inner panel in the area between said opening and said side edge to provide, with said inner and outer panels three plies of carton material in said area;

(e) said top wall outer panel including:

(i) a multi-finger receiving opening of of substantially the same contour as and disposed to overlie said inner panel opening;

(ii) an integral strip of material disposed between said outer panel opening and a free side edge of said outer panel;

(iii) a thumb receiving opening, only large enough to accommodate a single thumb, spaced from said multi-finger receiving openings a distance substantially equal to the width of said reinforcing flap;

(f) said top wall outer panel having a contour substantially equal in area to the cross-sectional area of the upper end of said tubular structure less an area equal to that of said reinforcing flap;

(g) said openings cooperating with each other and with said three plies of carton material therebetween to provide a strong handle arrangement whereby when the top wall is grasped like a bowling ball twisting of the material of the carton between said openings is minimized.

2. A carton according to claim 1, wherein said top wall outer panel and said bottom wall panel present end edges each have foldably joined thereto a single flap extending the full width of the tubular structure, with adjacent flaps at each end of the carton being secured to each other in lapped relation to close the ends of the tubular structure.

3. A blank of foldable sheet material, such as paperboard, cut and scored to provide a carrier carton and comprising:

(a) a bottom wall panel;

(b) a pair of side wall panels foldably joined at their inboard side edges to opposed side edges of said bottom wall panel;

(c) a pair of top wall inner and outer panels foldably joined at their inboard edges to adjacently outboard edges of respective side wall panels;

(d) said inner panel including:

(i) a multi-finger receiving opening spaced inboardly from an outboard side edge thereof;

(ii) an elongated reinforcing flap foldably joined at its inboard side edge to said inner panel outboard side edge and having a width substantially equal to the distance between said inner panel opening and said outboard side edge;

(e) said outer panel including:

(i) a multi-finger opening, of substantially the same contour as the multi-finger opening of said inner panel, spaced inboardly from an outboard edge of said outer panel;

(ii) a thumb receiving opening, only large enough to accommodate a single thumb, spaced inboardly from said outer panel multi-finger receiving opening a distance equal to the width of said inner panel reinforcing strip;

(f) said top wall outer panel having a recess at the outboard side thereof, said recess having a contour that conforms to the contour of said inner panel reinforcing flap.

4. A blank according to claim 3, and including end closure flaps foldably joined to opposite end edges of said outer top wall panel and said bottom wall panel.

5. A blank according to claim 4, wherein each of said top wall outer panel end flaps extends the entire width of said outer panel at the end edge thereof.

* * * * *